US008492966B2

(12) United States Patent
Hagmann

(10) Patent No.: US 8,492,966 B2
(45) Date of Patent: Jul. 23, 2013

(54) SYMMETRIC FIELD EMISSION DEVICES USING DISTRIBUTED CAPACITIVE BALLASTING WITH MULTIPLE EMITTERS TO OBTAIN LARGE EMITTED CURRENTS AT HIGH FREQUENCIES

(76) Inventor: Mark J. Hagmann, West Valley City, UT (US)

( * ) Notice: Subject to any disclaimer, the term of this patent is extended or adjusted under 35 U.S.C. 154(b) by 875 days.

(21) Appl. No.: 12/566,972

(22) Filed: Sep. 25, 2009

(65) Prior Publication Data

US 2011/0074293 A1 Mar. 31, 2011

(51) Int. Cl.
*H01J 1/02* (2006.01)

(52) U.S. Cl.
USPC ..... 313/309; 313/336; 313/497

(58) Field of Classification Search
USPC ..... 313/309, 336, 351, 495, 496, 497
See application file for complete search history.

(56) References Cited

U.S. PATENT DOCUMENTS

| | | | | |
|---|---|---|---|---|
| 4,493,087 | A | 1/1985 | Laakman et al. | |
| 5,541,466 | A | 7/1996 | Taylor et al. | |
| 5,679,895 | A * | 10/1997 | von Windheim | 73/514.25 |
| 5,767,620 | A * | 6/1998 | Onodaka | 313/495 |
| 6,538,367 | B1 | 3/2003 | Choi et al. | |
| 6,710,396 | B1 * | 3/2004 | Wu | 257/315 |
| 6,819,054 | B2 | 11/2004 | Johnson et al. | |
| 7,105,852 | B2 | 9/2006 | Moddell et al. | |
| 7,235,912 | B2 * | 6/2007 | Sung | 310/306 |
| 2004/0145299 | A1 * | 7/2004 | Wang et al. | 313/497 |
| 2008/0160867 | A1 * | 7/2008 | Choi et al. | 445/24 |
| 2009/0072750 | A1 | 3/2009 | Akinwande et al. | |

OTHER PUBLICATIONS

G.N. Fursey, Field Emission in Vacuum Microelectronics, Kluwer, New York, 2005.

G.N. Fursey, L.M. Baskin, D.V. Glazanov, A.O. Yevgen'Ev, A.V. Kotcheryzhenkov and S.A. Polezhaev, "Specific features of field emission from submicron cathode surface areas at high current densities," J. Vac. Sci. Technol. B 16 (1998) 232-237.

R. Gomer, Field Emission and Field Ionization, American Institute of Physics, New York, 1993.

T. Fujieda, K. Higaka, M. Hayashibara, T. Kamino, Y. Ose, H. Abe, T. Shimizu and H. Tokumoto, "Direct observation of field emission sites in a single multiwalled carbon nanotube by Lorentz Microscopy," Jpn. J. Appl. Phys. 44 (2005) 1661-1664.

E. Takahashi and M. Sone, "Observation of field emission sites and study of heat treatment effects," IEEE Trans. Dielect. Electr. Insul. 5 (1998) 929-934.

M. Okawa, T. Shiori, H. Okubo and S. Yanabu, "Area effect on electric breakdown of copper and stainless steel electrodes in vacuum," IEEE Trans. Electr. Insul. 23 (1988) 77-81.

B.M. Cox, "The nature of field emission sites," J. Phys. D, 8 (1975) 2065-2073.

(Continued)

*Primary Examiner* — Tung X Le
(74) *Attorney, Agent, or Firm* — Geoffrey E. Dobbin; Dobbin IP Law P.C.

(57) ABSTRACT

Field emission devices utilizing capacitive ballasting are described with possible uses in industry. The preferred device utilizes opposing electrodes, each with a dielectric layer and a plurality of conductive islands which serve to exchange electrons, generating an oscillatory current. Ideally these islands are dome-shaped and made of a refractory metal such as tungsten of molybdenum. Through proper use and selection of materials, electrical fields with densities of $10^{14}$ A/m$^2$ are capable of being generated.

13 Claims, 8 Drawing Sheets

OTHER PUBLICATIONS

M.J. Hagmann, "Photomixing in resonant laser-assisted field emission—A new technique for wideband-tunable Terahertz sources," IEEE Trans. Microwave Theory Tech. 52 (2004) 2361-2365.
C.A. Spindt, C.E. Holland, P.R. Schowebel and I. Brodie, "Field-emitter-array development for microwave applications," J. Vac. Sci. Technol. B 14 (1996) 1986-1989.
T. Utsumi, "Historical Overview," in W. Zhu ed., Vacuum Microelectronics, Wiley, New York, 2001.
C.O. Bozler, C.T. Harris, S. Rabe, D.D. Rathman, M.A. Hollis, and H.I. Smith, "Arrays of gated field-emitter cones having 0.32 μm tip-to-tip spacing," J. Vac. Sci. Technol. B 12 (1994) 629-632.
G.L. Bilbro, Theory of nanotip formation, J. Vac. Sci. Technol. B 20 (2002) 757-761.
E.G. Pogorelov, A.I. Zhbanov and Y.-C. Chang, "Field enhancement factor and field emission from a hemi-ellipsoidal metallic needle," Ultramicroscopy, 109 (2009) 373-378.
S. Chattopadhyay, L.-C. Chen and K.-H Chen, "Nanotips: Growth, model, and applications," Crit. Rev. Solid State 31 (2006) 15-53.
M. Wang, Z.H. Li, X.F. Shang, X.Q. Wang and Y.B. Xu, "Field-enhancement factor for carbon nanotube array," J. Appl. Phys. 98 (2005) 014315.
S.R.P. Silva, G.A.J. Amaratunga and J.R. Barnes, "Self-texturing of nitrogenated amorphous carbon thin films for electron field emission," Appl. Phys. Lett. 71 (1997) 1477-1479.
F. Song, F. Zhou, H. Bu, X. Wang, L. He, M. Han, J. Wan, J. Zhou and G. Wang, "Films with discrete nano-DLC-particles as the field emission cascade," J. Phys. D: Appl. Phys. 41 (2008) 042001.
N. Mansour, M.J. Soileau and E.W. Van Stryland, Picosecond Damage in Y2O3 Stabilized Cubic Zirconia, National Bureau of Standards Special Publication, 1986, pp. 31-38.
J. Han, C. Li, M. M Zhang, H. Zuo and S. Meng, "An investigation of long pulsed laser induced damage in sapphire," Op. Laser Technol. 41 (2009) 339-344.
R. S. Sussmann, G.A. Scarsbrook, C.J.H. Wort and R.M. Wood, "Laser damage testing of CVD-grown diamond windows," Diam. Relat. Mater. 3 (1994) 1173-1177.
J.B. Oliver, S. Papernov, A.W. Schmid and J.C. Lambropoulos, "Optimization of laser-damage resistance of evaporated hafnia films at 351 nm," Proc. SPIE vol. 7132 (2008) 71320J.
Y. Yasojima, Y. Ohmori, N. Okumura and Y. Inuishi, "Optical dielectric breakdown of alkali-halide crystals by Q-switched lasers," Jpn. J. Appl. Phys. 14 (1975) 815-824.
M.A. Angadi, T. Watanabe, A. Bodapati, X. Xiao, O. Auciello, J.A. Carlisle, J.A. Eastman, P. Keblinski, P.K. Schelling and S.R. Phillpot, "Thermal transport and grain boundary conductance in ultrananocrystalline diamond thin films," J. Appl. Phys. 99 (2006) 114301.
M.J. Hagmann, "Stable and efficient numerical methods for solving the Schrödinger Equation to determine the response of tunneling electrons to a laser pulse," Int. J. Quant. Chem. 70 (1998) 703-710.
M.J. Hagmann, "Single-photon and multiphoton processes causing resonance in the transmission of electrons by a single potential barrier in a radiation field," Int. J. Quant. Chem. 75 (1999) 417-427.
A.V. Petukhov, V.L. Brundy, W.L. Mochan, J. Maytorena, B. Mendoza and T. Rasing, "Energy conservation and the Manley-Rowe Relations in surface and non-linear optical spectroscopy," Phys. Rev. Lett. 81 (1998) 566-569.
G.P. Williams, "High-power terahertz synchrotron sources," Phil. Trans. R. Soc. Lond. A362 (2004) 403-414.
A.V. Batrakov, I.V. Pegel and D.I. Proskurovskii, "Limitation of the field emission current density by the space charge of the emitted electrons," Technical Physics Letters 25 (1999) 454-455.
L. Schacter, "Analytic expression for triple-point electron emission from an ideal edge," Appl. Phys. Lett. 72 (1998) 421-423.
N.M. Jordan, Y.Y. Lau, D.M. French, R.M. Gilgenbach and P. Pengavanich, "Electric field and electron orbits near a triple point," J. Appl. Phys. 102 (2007) 033301.
M.S. Chung, S.C. Hong, P.H. Cutler, N.M. Miskovsky, B.L. Weiss and A. Mayer, "Theoretical analysis of triple junction field emission for a type of cold cathode," J. Vac. Sci. Technol. B 24 (2006) 909-912.
C.D. Marshall, A. Tokmakoff, I.M. Fishman, C.B. Eom, J.M. Phillips and M.D. Fayer, "Thermal boundary resistance and diffusivity measurements on thin YBa2Cu3O7-X films with MgO and SrTiO3 substrates using the transient grating method," J. Appl. Phys. 73 (1993) 850-857.
R.J. Stevens, L.V. Zhigilei and P. M. Norris, "Effects of temperature and disorder on thermal boundary conductance at solid-solid interfaces: Nonequilibrium molecular dynamics simulations," Int. J. Heat Mass Tran. 50 (2007) 3977-3989.
M.W. Denhoff, "An accurate calculation of spreading resistance," J. Phys. D: Appl. Phys. 39 (2006) 1761-1765.
P.-O. Chapuis, J.-J. Greffet, K. Joulian and S. Volz, "Heat transfer between a nano-tip and a surface," Nanotechnology 17 (2006) 2978-2981.
P.-O. Chapuis, S. Volz, C. Henkel, K. Joulian and J.-J. Greffet, "Effects of spatial dispersion in near-field radiative heat transfer between two parallel metallic surfaces," Phys. Rev. B 77 (2008) 035431.

* cited by examiner

SYMMETRIC FIELD EMISSION DEVICES USING DISTRIBUTED CAPACITIVE BALLASTING WITH MULTIPLE EMITTERS TO OBTAIN LARGE EMITTED CURRENTS AT HIGH FREQUENCIES

CROSS-REFERENCES TO RELATED APPLICATIONS

This application claims priority as a non-provisional perfection of prior filed U.S. Provisional Application No. 61/325,854, filed Aug. 21, 2009, which is incorporated herein in its entirety by reference.

FIELD OF THE INVENTION

The present invention relates to the emission of charged particles in high electric fields and more particularly relates to methods and devices capable of high current field emission at high frequencies that utilize capacitive ballasting.

BACKGROUND OF THE INVENTION

In field emission an intense electric field, typically 5 to 10 V/nm, is applied to the surface of an electrically conductive material such as a refractory metal or semiconductor to lower the potential barrier so that electrons can tunnel into the surrounding medium such as air or vacuum. Theoretical studies suggest that the high density of conduction band electrons in metals could support field emission current densities as high as $10^{16}$ A/m$^2$ [1]. However, the current density is usually much less than this limit because of instabilities that are caused by heating. Current densities that are near this limit are obtained when the electric field is applied in nanosecond pulses with a low duty cycle to limit the average heating. Currents as high as 20 to 40 mA [2] with current densities as high as $10^{15}$ A/m$^2$ [1] are obtained from emitters smaller than 4 nm because this is much less than the mean free path for electron-phonon scattering (≈10 nm), which reduces the heating. Cooling a field emitter to temperatures of 2 to 4° K makes it possible to use currents that are two or three times those at room temperature [1]. By contrast, field emission tips of refractory metals such as tungsten with a radius of approximately 100 nm have an upper limit of $10^9$ A/m$^2$ in sustained operation at room temperature [3].

The maximum current that can be obtained by field emission does not increase in proportion to the area of the emitter. This may be understood because field emission is not uniform over the tip, but is limited to a small number of sites where contaminants reduce the work function or nanoprotrusions enhance the local electric field [4-7]. We have studied the large data base for field emitters of diamond having areas from $6\times10^{-16}$ to $2\times10^{-4}$ m$^2$ to obtain the empirical equation $I=5.5\times A^{0.25}$, where I is the emitted current in milliamperes and A is the area of the emitter in square meters. Others have shown that the emitted current is proportional to $A^{0.28}$ for copper and $A^{0.24}$ for stainless steel [6]. Thus, increasing the field emission current from 1 μA to 1 mA would require that the area be increased by a factor of $10^{12}$ which is $10^9$ times what would be necessary if the current density were independent of the area of the emitter.

Field emitter arrays (FEAs), having a large number of microtriodes with conical field emitters, are used to obtain a constant current density over large areas; e.g. 160 mA with an area of 7450 μm$^2$ [10]. The total current can be stabilized by placing a single ballast resistor [11] or a single electronic constant-current source in series with the array [12]. It would not be practical to use either of these methods to divide the current evenly between all of the emitters in an array because the fabrication already requires multiple processes of deposition and lithography. However, FEAs have been made in which each emitter is formed on a separate pillar-shaped ungated field-effect transistor which limits the current for that emitter by velocity saturation [13]. Analyses of the effects of the structural parameters for FEAs, including the gate electrodes of the triodes and the small fraction of the total area contributing to the current, show that the overall current density from a FEA can not exceed $2.2\times10^7$ A/m$^2$ for steady-state operation in vacuum [14], and FEAs that approach this limit have been demonstrated [10,15]. Field emitter arrays are the only example of prior art that can provide this high of an overall current density in steady-state over areas that are greater than 10 μm$^2$.

This disclosure describes methods for increasing the total current of emitted electrons by increasing the effective area of a cathode instead of having a limited number of emitter sites. Such an increase in the current would be useful in many applications. For example, the output power could be increased in microwave and terahertz sources that are based on photomixing in laser-assisted field emission because the power is proportional to the square of the current but the size of the emitter must be less than the wavelength of the laser radiation [8]. The present invention is especially appropriate for applications where metal-insulator-metal (MIM) diodes are now used, such as high-speed mixers, in which the current is caused by electrons tunneling through a dielectric [9]. This is because the present invention uses a gas such as air or a vacuum in place of the solid dielectric so the dielectric constant is reduced to unity, and the current is caused by field emission so the gap may be much greater in length. These two changes cause the shunting capacitance, which limits high-frequency operation, to be much less than it is in MIM diodes. Thus, the present invention may be used at higher frequencies, or the cross-sectional area may be increased to provide much greater current. Other possible applications include gas ionizers, gas pressure sensors, and various types of microwave devices.

SUMMARY OF THE INVENTION

In view of the foregoing disadvantages inherent in the known types of electrical field emission devices, this invention provides an improved electrical field emission device utilizing capacitive ballasting. As such, the present invention's general purpose is to provide a new and improved field emission device capable of emitting fields with a current density on the order of $10^{14}$ A/m$^2$.

To accomplish this objective, the field emitter device comprises two symmetrically opposed electrodes with facing electrically conductive layers. The layers are in turn coated with a dielectric layer which presents a plurality of conductive "islands" which serve to emit the charged particles.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DESCRIPTION OF THE PREFERRED EMBODIMENT

With reference now to the drawings, the preferred embodiment of the field emission device is herein described. It should be noted that the articles "a", "an", and "the", as used in this specification, include plural referents unless the content clearly dictates otherwise.

Figure 2:
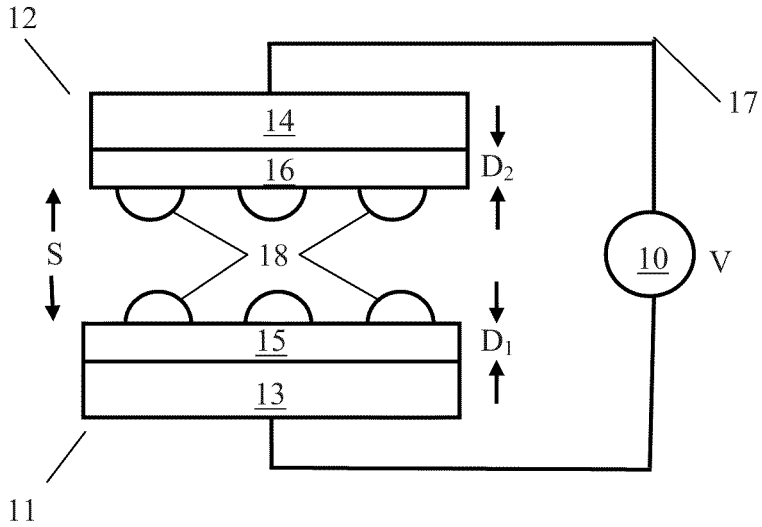
FIG. 2 is an electrical diagram showing capacitive ballasting.

Requirements for Multiple Conductive Islands,

In the present invention, shown in FIG. 2 there are two electrodes 11, 12, each has an electrically conductive layer 13, 14 that is connected to an external circuit 17, and is coated with a dielectric interface layer 15, 16 that distributes the total current evenly between many small electrically-conductive islands 18 which are field emitters. Let A be the area of the interface, and N and R be the number of the islands and the approximate radius of the base for each island. The fraction of the area of the interface that is covered by the islands is given by $\gamma = N\pi R^2/A$, which is typically between 1 and 30%. Each island should have a height that is no greater than 2R, and it should be domelike, ideally curved in such a way that the electric field has constant magnitude over the full exposed area for uniform emission over this area which exceeds that for the base of the island. Emitting tips with this shape are more stable at high currents because the outward pressure caused by the intense electric field is balanced by the surface tension [16]. In some implementations of this invention R may be less than 4 nm so that the average current density from each island can be as high as $10^{15}$ A/m$^2$[1].

Protrusions, such as the conductive islands 18, increase the local value of the electric field on a flat cathode by a factor of $\beta$ which is called the "field enhancement factor", thus increasing the emitted current [17]. For example, a hemispherical island would have $\beta=3$ and greater enhancement is obtained with emitters having much larger aspect ratios which are generally preferred for field emitters [18]. However, when many tall emitters are used, such as in an array of carbon nanotubes, it is necessary to limit their number so that their spacing is greater than their height. Otherwise the emitters will shield each other from the static field, reducing the effective value of $\beta$, which decreases the field emission current [19]. Prior art describes means for increasing the spacing in an array to reduce the effects of shielding [20]. However, in the present invention we use conductive islands with an aspect ratio (height divided by diameter) that is unusually low, typically from 0.2 to 1.0, so the spacing can be reduced to have more islands for a greater current. The reduced aspect ratio also provides greater stability at the higher currents as was already mentioned. Various processes have been used to form nanotips for field emission [18], and these methods could be applied to form the conductive islands in the present invention. Field emitters having multiple domelike structures of nanometer size have also been formed from nitrogenated amorphous carbon thin film [21] and diamond-like-carbon [22].

Limitations of Conventional Resistive and Semiconductor Ballasting

In the present invention the interface divides the total current evenly between the conducting islands 18 which is essential to provide the maximum total emitted current without burning out many of the individual islands. The following table defines three different cases which are considered in which the conductive islands have different sizes which permit different upper limits for the current density:

TABLE 1

Definition of the three cases for the conductive islands.

| | Case 1 | Case 2 | Case 3 |
|---|---|---|---|
| Radius of the base of each island, R | ≈100 nm | ≈10 nm | <4 nm |
| Maximum current density per island, $J_0$ | $10^9$ A/m$^2$ | $10^{12}$ A/m$^2$ | $10^{15}$ A/m$^2$ |

These three cases are chosen because it is possible to maintain these currents over emitters having the respective sizes. An island is destroyed by thermal burnout if the current density exceeds the value of $J_0$. The following two extensions of the previous art could be considered for the function of dividing the current between the islands, but it will be seen that neither of them is appropriate for the extremely high currents that are possible in the present invention.

Figure 1:
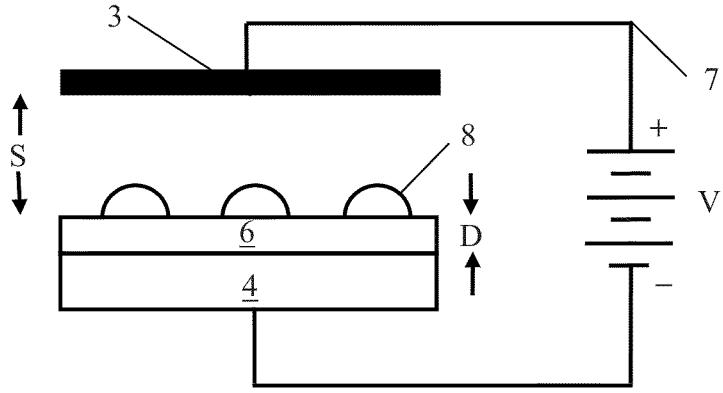
FIG. 1 Prior Art
FIG. 1 is an electrical diagram showing prior art resistive and semiconductor ballasting.

(1) Resistive ballasting could be extended to approximate a separate resistor is series with each conductive island 8 by having a common continuous resistive interface layer 6 with a thickness $D<R/\sqrt{\gamma}$ as shown in FIG. 1. As with the FIG. 2, the resistive interface layer 6 resides on a conductive layer 4 connected to a circuit 7. Anode 3 is also so connected. This method was simulated with a model in which $10^4$ islands have a Gaussian distribution for their work functions in which the mean value is that of tungsten (4.5 eV) and the standard deviation ($\sigma$) is 10% of the mean, in order to show that the reduction in current which is caused by variations in the sizes, shapes, and work functions of the islands can be mitigated. Solutions were obtained for islands having three sizes for the three cases, for which the current density would be $J_0$ if the standard deviation $\sigma$ were zero. As the applied voltage is increased, the mean value of the current density that is emitted by the islands increases until it reaches a maximum $J_{MAX}$, after which it decreases because the number of emitting islands is significantly reduced by burnout. It is necessary to define the effective resistivity of the interface, $\rho_{EFF}=\beta D\rho/S$, where $\beta$ is the field enhancement factor of each island, $\rho$ and D are the resistivity and the thickness of the interface, and S is the distance between the interface and the anode as shown in FIG. 1. Table 2 gives the values of F which is the fraction of the islands that are burned out, and $J_{MAX}/J_0$, for simulations in which the islands have the three different sizes. Because not all of the interface is covered by the conductive islands the overall effective current density, defined as the total emitted current divided by the total area of the substrate, is given by $J_{EFF}=\gamma J_{MAX}$.

TABLE 2

Results of simulations for resistive ballasting.

| Case | R, nm | $J_0$, A/m$^2$ | $\rho_{EFF}$, Ω-M | F | $J_{MAX}/J_0$ |
|---|---|---|---|---|---|
| 1 | ≈100 | $10^9$ | (0.0) | 0.4991 | 0.20 |
| 1 | ≈100 | $10^9$ | 23. | 0.0226 | 0.90 |
| 1 | ≈100 | $10^9$ | 90. | 0.0024 | 0.98 |
| 2 | ≈10 | $10^{12}$ | (0.0) | 0.2266 | 0.36 |
| 2 | ≈10 | $10^{12}$ | 0.042 | 0.0162 | 0.90 |
| 2 | ≈10 | $10^{12}$ | 0.20 | 0.0025 | 0.98 |
| 3 | <4 | $10^{15}$ | (0.0) | 0.0895 | 0.66 |
| 3 | <4 | $10^{15}$ | 0.00012 | 0.0206 | 0.90 |
| 3 | <4 | $10^{15}$ | 0.00069 | 0.0030 | 0.98 |

Table 2 shows that a continuous resistive interface could increase the mean value of the current density that is emitted by the islands. For example, with $J_0=10^9$ A/m$^2$ the average current density would be $2.0\times10^8$ A/m$^2$ without resistive ballasting, but it could be increased to $9.0\times 10^8$ A/m$^2$ or $9.8\times10^8$ A/m$^2$ by using resistive ballasting with $\rho_{EFF}=23$ or 90 Ω-M, respectively. However, for $J_{MAX}$ to equal 90% of $J_0$ with devices having $\beta=3$, D=10 nm, and S=50 nm and $J_0$ equal to $10^9$, $10^{12}$, and $10^{15}$ A/m$^2$, the interface must have a resistivity $\rho$ equal to 38, 0.070, and 0.00020 Ω-m, respectively which would cause enough heating to destroy these devices.

(2) Semiconductor ballasting could be used to approximate a separate semiconductor in series with each conductive island by having a common continuous semiconductor interface layer with thickness $D<R/\sqrt{\gamma}$. This is similar to the resistive layer 4 shown in FIG. 1. Field emitter arrays have already been made in which each emitter is formed on a separate pillar-shaped ungated field-effect transistor that limits the current by velocity saturation [13]. However, pillar-shaped transistors would not be practical in the present invention because they would cause $\beta$ to be too large, and they it would be difficult to make them for the small conductive islands. The use of a continuous semiconductor interface was simulated with a model that is represented in FIG. 1, in which $10^4$ islands have different work functions with a Gaussian distribution that has a mean value is that of tungsten and $\sigma$ is 10% of the mean. An ideal semiconductor was assumed, in which the local value of the resistivity varies to pass the same current to each island. Thus, if there were no variation in the emitters, each of the islands would have a current density equal to $J_0$ as an ideal device. However, because of the Gaussian distribution, the applied voltage must be large enough to increase field emission from the islands with the higher work functions, which requires the semiconductor to provide sufficient series resistance to avoid burnout of the islands with lower work functions. For example, if the applied voltage is high enough to provide a current density of $J_0$ at the emitters with a work function as high as 4.95 eV (mean+$\sigma$) and the semiconductor provides the resistance which is necessary to prevent burnout of the emitters with a work function as low as 4.05 eV (mean−$\sigma$), then 68.2% of the islands would emit a current density of $J_0$, 15.9% would emit below $J_0$, and 15.9% would be burned out. Thus, the mean value of the current density that is emitted by the islands would be between 68.2 and 84.1% of $J_0$. The resistance that the semiconductor must provide, and thus the heating of the interface, may be reduced by allowing a greater fraction of the islands to emit a current density less than $J_0$ and/or a greater fraction of burnout, but this would also reduce the mean value of the current density that is emitted by the islands. Simulations show that semiconductor ballasting, like resistive ballasting, would not be practical in the present invention because no materials are known that could provide the necessary resistivity with sufficient thermal conductivity to transfer the heat from the interface to prevent destruction of the device.

Introduction to Capacitive Ballasting

Figure 3:
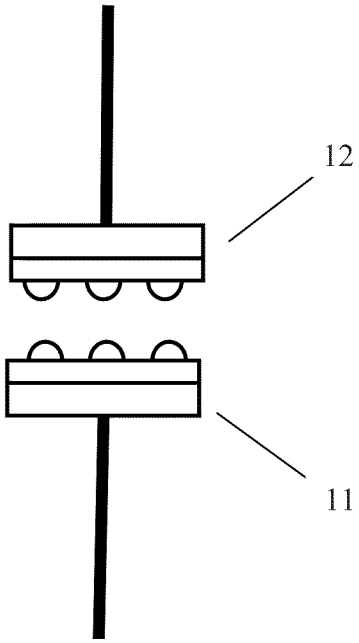
FIG. 3 is a side elevation of a dipole antenna manufactured according to the present invention.

In the present invention the interface divides the total current evenly between the conducting islands by means of capacitive ballasting, as shown in FIG. 2, instead of using the conventional resistive ballasting or semiconductor ballasting for which the dissipation of energy is a fundamental requirement. Thus, the current is distributed trough a reactance to have minimal heating that is caused only by the loss-factor of the dielectric. FIG. 2 shows a signal generator 10 as the source of the time-dependent applied voltage, which may be pulsed, sinusoidal, or have other waveforms that are appropriate for specific applications. Capacitive ballasting is especially appropriate for sources at microwave through optical frequencies, so a number of different means may be used to supply the time-dependent electric field including transmission lines and the reception of radiation by means of antennas. For example, FIG. 3 shows how a dipole antenna may be used to couple the device to a source of electromagnetic radiation. Prior art includes many other types of antennas that could be used at radio frequencies through optical frequencies. It is also appropriate to use two or more sources at different frequencies, where the two sources may have different power.

Capacitive ballasting requires that the devices in the present invention are symmetric, with conductive islands 16 on each of the two electrodes 11, 12 of the field emission diode as shown in FIG. 2, so that each side alternately emits and collects electrons during each cycle of the electric field. Otherwise there would be a unidirectional flow of current that would be followed by a cessation of field emission. Since the two halves of the diode are not perfectly matched there will always be some charging to cause a DC offset voltage after which the current flow is balanced. Each conductive island 18 is on a dielectric interface layer 15, 16, layered upon a conductive layer 13, 14, that forms a series capacitor, and these capacitors divide the total current evenly between the islands. This is necessary, both when the island emits and collects electrons, to maximize the total current with minimum burn-out of the islands. The sizes and other properties of the islands 18 and the interfaces on the two sides of the device should be matched with values selected so as to maximize the current and reduce the effects of capacitive shunting by the field emission diode in order to obtain optimum performance. The thickness of each dielectric layer, $D_1$ and $D_2$, should be less than $D<R/\sqrt{\gamma}$ that these layers approximate separate capacitors that are in series with each conductive island.

The phenomena of capacitive ballasting may be understood by considering the effects of the relative values of the time-dependent resistance that is caused by the field-emission diode and the reactance of the two capacitors which are in series with this resistance. Let the total voltage that is applied across the series circuit be $V=V_0 \sin(\omega t)$, and C' be the capacitance per unit area for each of the two capacitors. When the reactance is much greater than the resistance (sufficiently low frequencies and/or small values of the capacitance), except at the times during each cycle when the current is near zero, most of the applied voltage is across the two capacitors and the current density is approximately equal to $(\omega C' V_0/2)\cos(\omega t)$. However, when the reactance is much less than the resistance (high frequencies and/or large capacitance), most of the applied voltage is across the field emission diode and the current density has peak values which are equal to $\pm J_0$ at times equal to 1/4, 3/4, 5/4, . . . of the period, where $J_0$ is the current density that would occur if the capacitors were removed and a DC voltage $V_0$ was applied. The total DC current is defined as $I_0$. The peak value of the current density approaches $J_0$ as the reactance goes to zero. To summarize, for a given device the peak and RMS values of the current density are proportional to the frequency and independent of the field emission diode at low frequencies, but they approach separate asymptotes at high frequencies. Thus, in capacitive ballasting the regulation of the current depends upon the reactance in the same way that it depends on the resistance in resistive ballasting.

Considerations in the previous paragraph show that the peak value of the current density is equal to $J_0/2$, which is one-half of the maximum possible value, when the capacitive reactance is approximately equal to $V_0/I_0$ which occurs at the knee-frequency $f_K=J_0/(\pi C' V_0)$. The values of $V_0$ and $I_0$ that are required for field emission show that capacitive ballasting in devices for the three cases defined in Table 1 show that the knee-frequency is typically about 200 MHz for Case 1 and 200 GHz for Case 2, and it is necessary to use radiation at near infrared or optical wavelengths for Case 3.

Dielectrics Considered for Capacitive Ballasting

Tables 3, 4, and 5 give the properties of some of the dielectrics of interest for capacitive ballasting in cases 1, 2, and 3 of Table 1, where the sources could have frequencies up to 40 GHz, from 0.1-10 THz, and wavelengths of 400-1000 nm, respectively. Values of the dielectric constant $\in_r$ and the loss factor tan(δ) are given in all three tables, instead of the index of refraction and extinction coefficient, because the capacitors have dimensions that are much smaller than the corresponding wavelength. It is readily shown that when a resistive interface for distributed resistive ballasting is replaced with a dielectric interface having the same dimensions for capacitive ballasting, if the regulation caused by these two ballasts is equal, the energy dissipation is reduced in proportion to tan (δ). A change to capacitive ballasting with a dielectric of zirconium oxide in Case 3 would reduce the heating of the interface by a factor of $10^5$.

TABLE 3

Dielectrics for frequencies up to 40 GHz in Case 1.

| Dielectric material | $\in_r$, dielectric constant | tan(δ) | Thermal conduct. W/m ° K | EBD V/nm |
|---|---|---|---|---|
| Diamond-like nanocomposites (DLN) | 5.6 | (unknown) | 14 | 10. |
| Hafnium oxide | 30 | 0.003 @10 GHz | 23 | 2.4 |
| Bismuth zinc niobate | 180 | 0.003 @20 GHz | 1.5 | 0.40 |
| Zirconium oxide | 33 | 0.0009 @40 GHz | 2.0 | 2.0 |
| Aluminum oxide | 11.6 | 0.001 @10 GHz | 40 | 1.0 |
| Diamond (UNCD) | 5.7 | 0.003 @10 GHz | 12 | 1.0 |
| Aluminum nitride | 8.7 | 0.001 @10 GHz | 350 | 0.55 |

TABLE 4

Dielectrics for frequencies from 0.1 to 10 THz in Case 2.

| Dielectric material | $\in_r$, dielectric constant | tan(δ) | Thermal conductance W/m ° K | EBD V/nm |
|---|---|---|---|---|
| Aluminum oxide | 9.6 | 0.0003 | 40 | 1.0 |
| Zirconium-tin-titanate | 98. | 0.0006 | 2.5 | 0.70 |
| Diamond (UNCD) | 5.8 | 0.00008 | 12 | 1.0 |

TABLE 5

Dielectrics for wavelengths from 400 to 1000 nm in Case 3.

| Dielectric material | $\in_r$, dielectric constant | tan(δ) | Thermal conductance W/m ° K | EBD V/nm |
|---|---|---|---|---|
| Hafnium oxide | 4.0 | 0.00002 | 23 | 2.4 |
| Diamond (UNCD) | 5.8 | 0.00001 | 12 | 1.0 |
| Zirconium oxide | 4.8 | 0.00001 | 2.0 | 2.0 |
| Aluminum oxide | 3.2 | 0.00004 | 40 | 1.0 |

The DC electric field for dielectric breakdown, EBD in units of V/nm, may be used to determine upper limits for the applied electric field at the frequencies for cases 1 and 2. However, the EBD depends on imperfections in the dielectric so the values in tables 3 and 4 were chosen for dielectric films with appropriate thickness that have high purity or optimal doping [23] to maximize this parameter. At much higher frequencies, such as in Table 5, it is necessary to consider how the measured threshold for laser-induced damage relates to the EBD. The laser-induced damage threshold measured with thick samples corresponds to an electric field within the dielectric that is less than 1% of the EBD, which is caused by thermal melting instead of electrical breakdown [24]. When the measurements are made with nanosecond laser pulses to limit heating, the damage threshold is much greater but it is more sensitive to sample imperfections than the EBD [25,26]. Measurements with homogeneous dielectrics show that the threshold electric field for laser-induced damage is approximately equal to the EBD [27], so we assume that if sufficient care is taken in preparing the dielectric film it is appropriate to use the EBD as the criterion for determining the upper limit for the applied electric field even in Case 3.

For capacitive ballasting a dielectric should have (1) High EBD so the film may be thin enough to approximate separate capacitors in series with each island and also provide good heat transfer; (2) Low dielectric loss to reduce heating; (3) High thermal conductivity to transfer the heat generated in the islands and the film to the supporting conductive layer; and (4) High dielectric constant to provide the required capacitance. Films of CVD diamond would provide excellent heat transfer because they have a thermal conductivity of 2200 W/m° K, but they are not suitable for capacitive ballasting in the present invention because the large crystallites require that the film thickness is at least 10 μm to limit roughness and porosity. Ultrananocrystalline diamond (UNCD) films, with a grain size of 3-5 nm, could be used in all three cases, but low conductance at the grain boundaries limits their thermal conductivity to 12 W/m° K [28]. Diamond-like nanocomposites (DLN) have a carbon network with diamond-like bonding that is chemically stabilized by hydrogen atoms having a silicon network with quartz-like bonding that is chemically stabilized by oxygen atoms [29]. The unusually high EBD of DLN shows promise for applications in the present invention, but this material has not been used in the following examples because the dielectric properties at the appropriate frequencies were not available.

Examples of Designs with Capacitive Ballasting

Table 6 gives the design parameters for examples 1, 2, and 3 which correspond to cases 1, 2, and 3, respectively, as defined in Table 1. The method for designing a device is as follows:

(1) Choose one of the three cases for appropriate values of R and $J_0$.

(2) Choose a suitable material for the conductive islands and use the Fowler-Nordheim equation or other means of simulation as may be appropriate to determine the DC electric field $E_0$ that is required to obtain the current $J_0$. Refractory metals, such as tungsten and molybdenum, are preferred for the material for the islands due to their high heat dissipative characteristics and high tensile strength, thus allowing them to resist field pressures.

(3) Specify suitable values for β and S, and determine the DC applied voltage $V_0$ that would be required to produce the electric field $E_0$, and use $V_0$ for the peak value of the sinusoidal applied voltage (e.g. $V_0=(S-R)E_0/\beta$ to allow for the height of the islands).

(4) Choose a suitable dielectric with known values of $\in_r$ and EBD. Specify $E_D$, the maximum electric field in the capacitors as a fraction of EBD (e.g. $E_D$=0.75*EBD).

(5) Assume that the maximum voltage across each capacitor is equal to $0.5*V_0$ to use $0.5*V_0/E_D$ as the minimum value for both $D_1$ and $D_2$.

(6) Set $\gamma=(R/D_1)^2$ which is the maximum value for which each dielectric interface approximates separate capacitors that are in series with each conductive islands.

(7) Estimate the knee-frequency $f_K=J_0/(\pi C'V_0)$.

Figure 4:
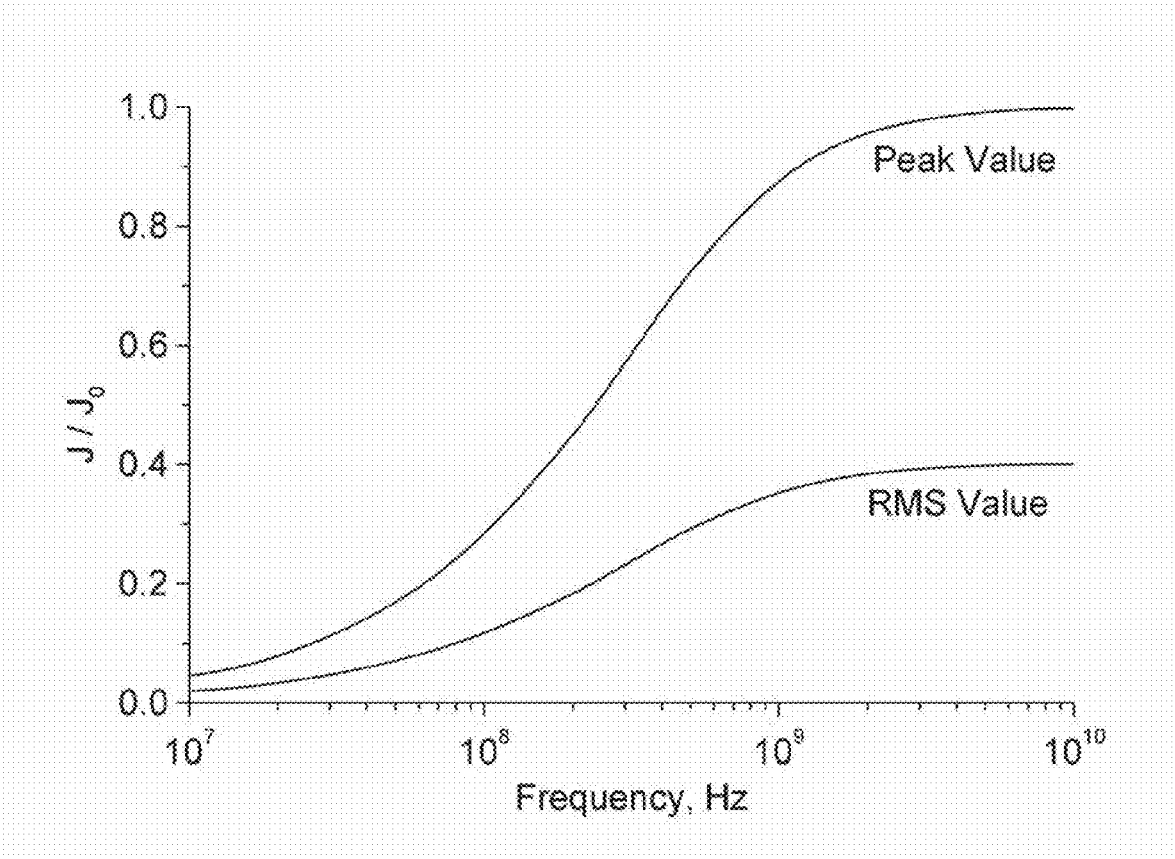
FIG. 4 is a graph depicting Peak and RMS values of the mean current density for the islands in Example 1, below, calculated without allowing for variations in the islands or burnout.
Figure 5:
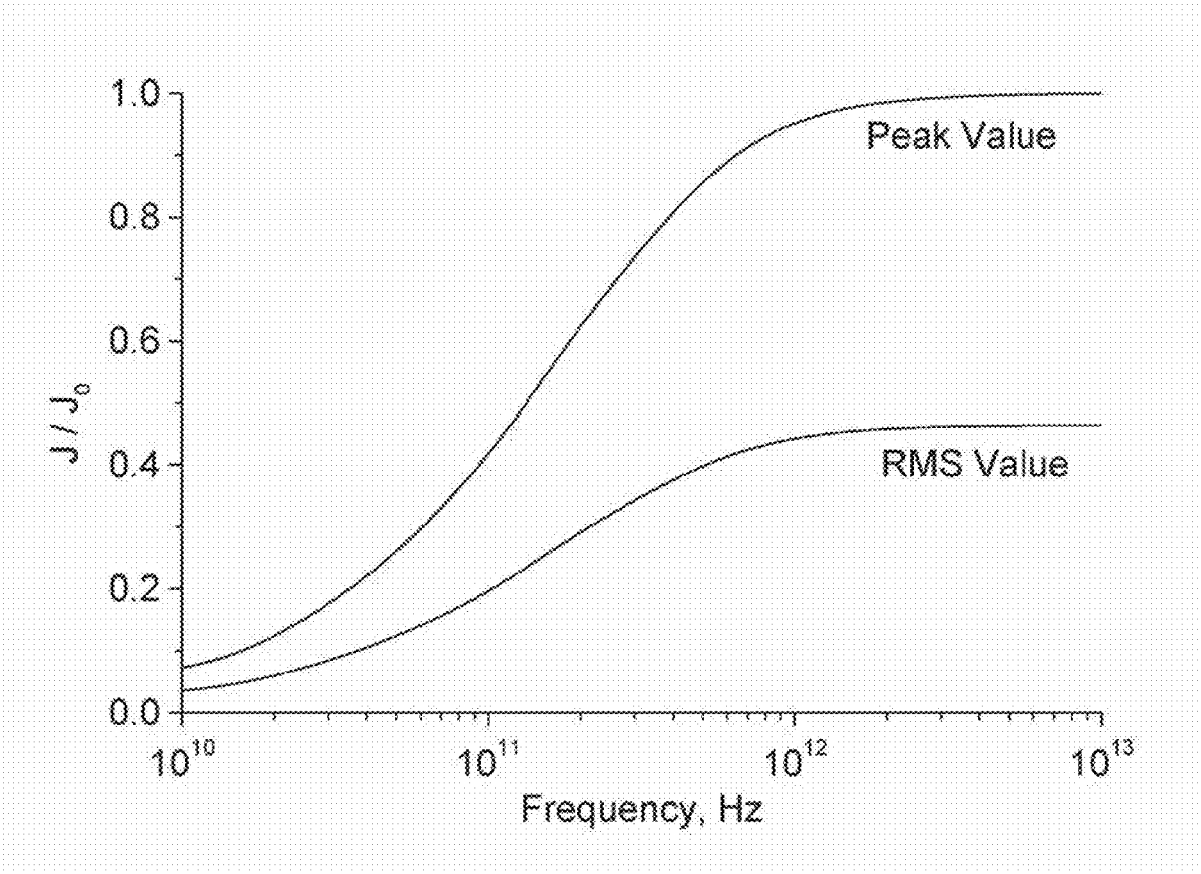
FIG. 5 is a graph depicting Peak and RMS values of the mean current density for the islands in Example 2, below, calculated without allowing for variations in the islands or burnout.
Figure 6:
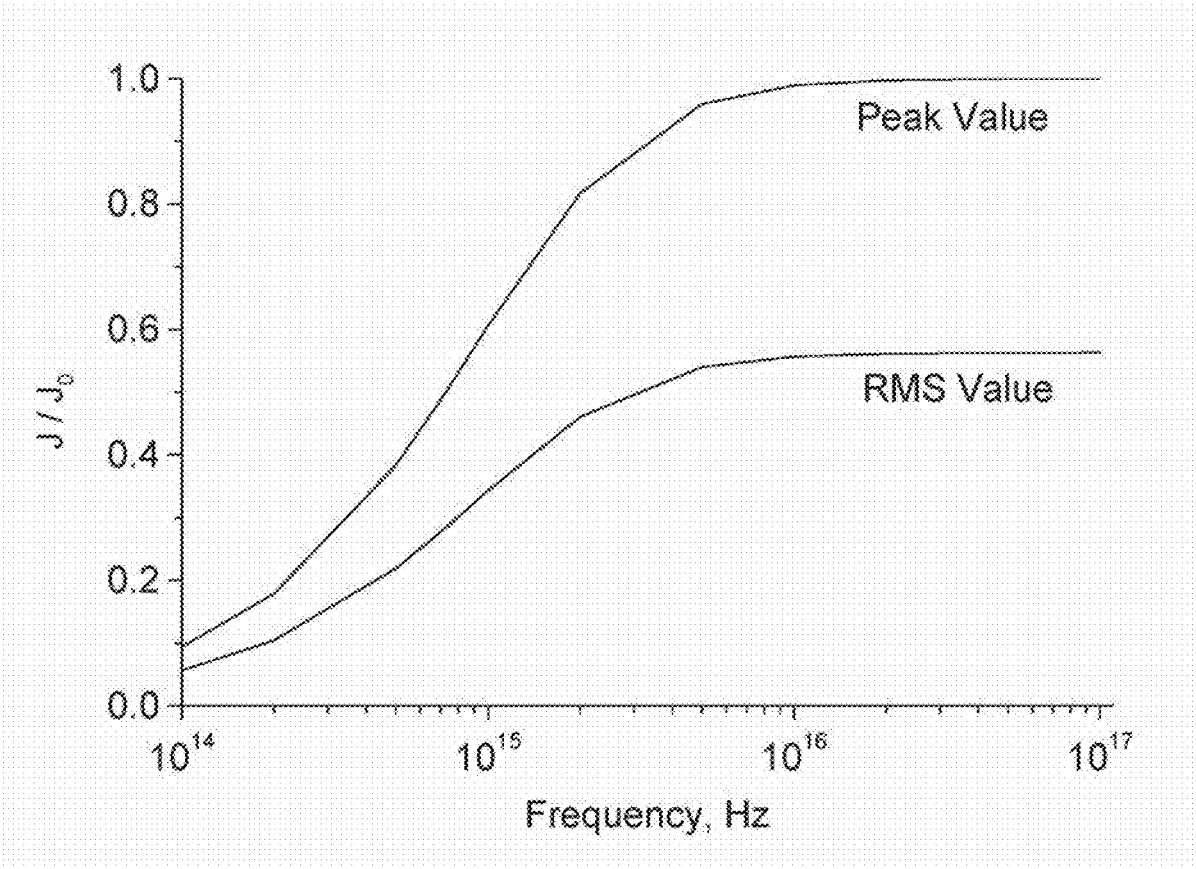
FIG. 6 is a graph depicting Peak and RMS values of the mean current density for the islands in Example 3, below, calculated without allowing for variations in the islands or burnout.

(8) In the seven previous steps constraints were applied to determine a set of design parameters, but now a nonlinear ordinary differential equation which describes the circuit of each device, including the field emitter diode, must be solved numerically to model the performance. FIGS. 4-6 show the normalized peak and RMS values of the mean current density from the islands as a function of the frequency of the applied voltage for examples 1-3, assuming a group of identical conductive islands (σ=0) and not allowing for the effects of burnout. In this approximation the peak and RMS values of the current density are proportional to the frequency and independent of the field emission diode at low frequencies, and approach asymptotes at high frequencies, as noted previously in considering the effects of the relative value of the reactance.

Figure 7:
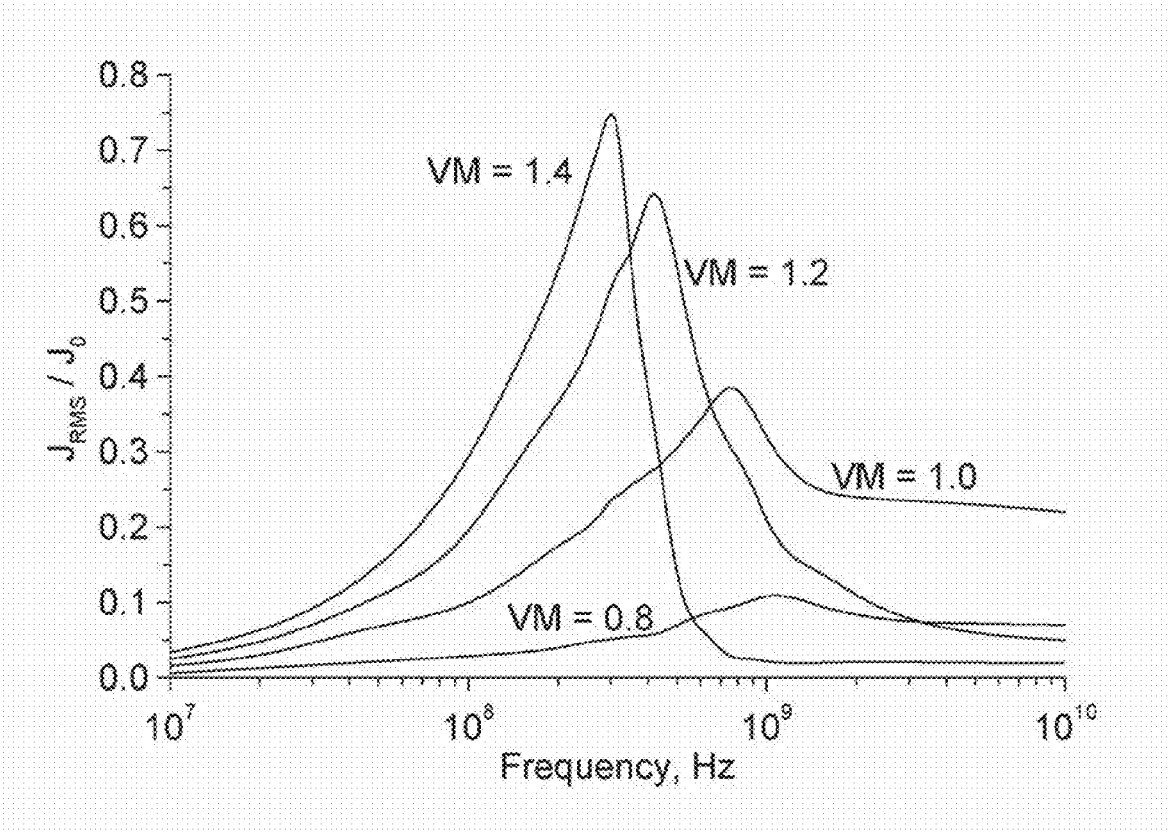
FIG. 7 is a graph depicting RMS value of the mean current density for the islands in Example 1, below, calculated allowing for a distribution in the properties of the islands and burnout.
Figure 8:
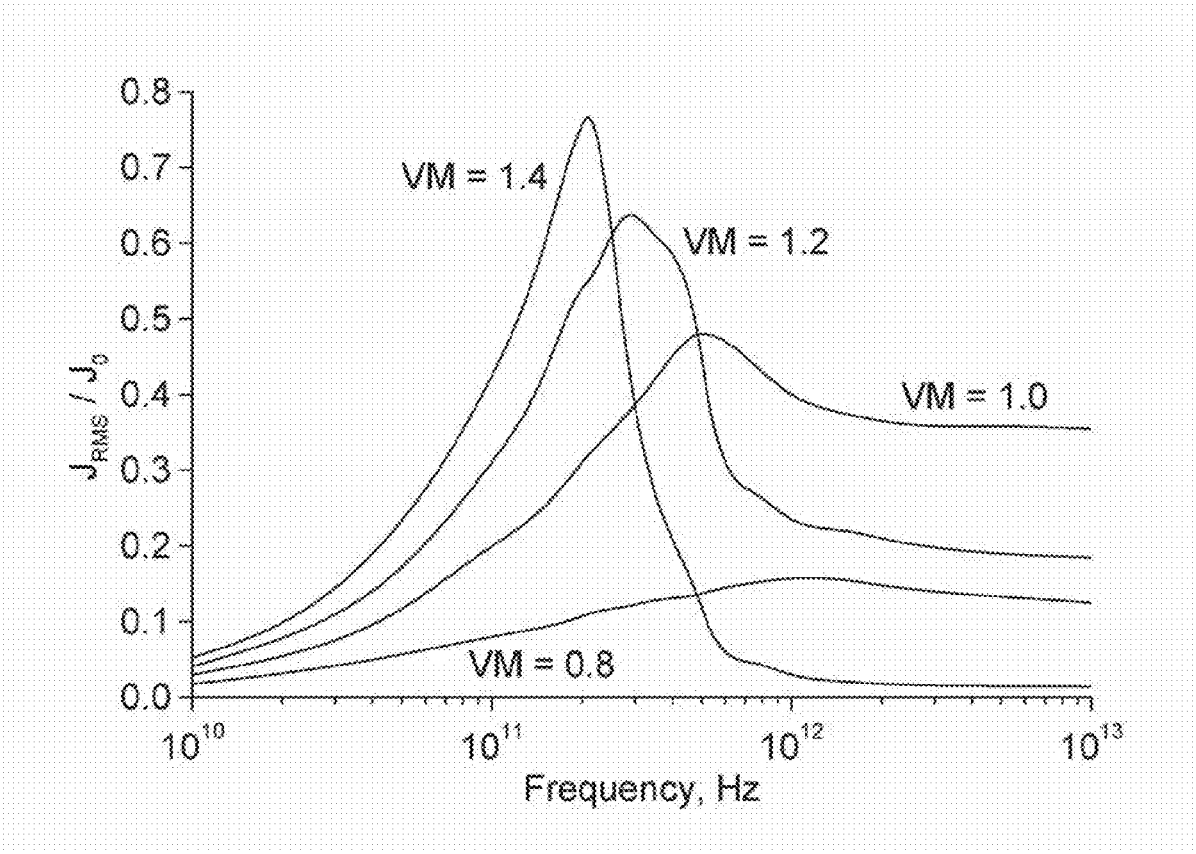
FIG. 8 is a graph depicting RMS value of the mean current density for the islands in Example 2, below, calculated allowing for a distribution in the properties of the islands and burnout.
Figure 9:
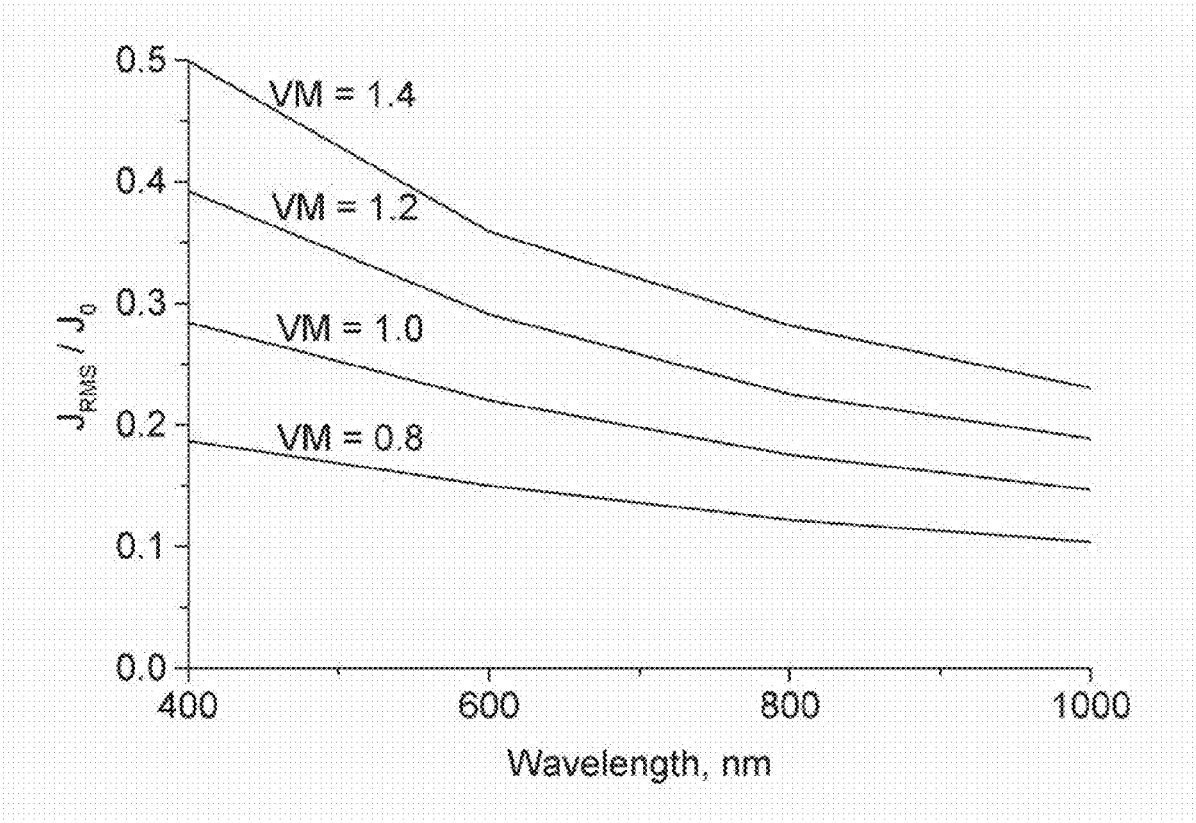
FIG. 9 is a graph depicting RMS value of the mean current density for the islands in Example 3, below, calculated allowing for a distribution in the properties of the islands and burnout.

(9) FIGS. 7-9 show the RMS value of the mean current density for the islands in examples 1-3, allowing for a distribution of the work functions and burnout of the islands. A Gaussian distribution for the work functions is used in which the mean value is that for tungsten and σ is 10% of the mean, to show the effects which are caused by the variations in the islands. Since field emitters are destroyed by heating, the criterion for burnout is that the RMS current density for an island exceeds $J_0$. The parameter VM is the ratio peak value of the applied voltage to $V_0$, and it does not exceed 1.4 which is the point at which dielectric breakdown would occur. As VM is increased, the maximum value of $J_{RMS}$ approaches $J_0$, and the full-width at half-maximum is narrower because burnout becomes more prominent. These figures show no knee, but the knee-frequency $f_k$, which was determined before solving the differential equation, has value in predicting the approximate frequency of the peaks with large values of VM. For Example 3 these maxima would be in the far UV so the values are only given in a region of the spectrum that would be more convenient for applications with lasers. Values of $J_{RMS}/J_0$ and the frequency $f_P$ at the peaks for VM=1.0 and 1.2 are entered in Table 6 for examples 1 and 2, and values at a wavelength of 405 nm are given for Example 3.

(10) Calculate the corresponding values of the overall effective RMS current density, $J_{EFF}=\gamma J_{RMS}$, which allows for incomplete coverage of the dielectric interface by the islands.

TABLE 6

Design parameters for the three examples.

| | Example 1 | Example 2 | Example 3 |
|---|---|---|---|
| R, nm | 100. | 10. | 4.0 |
| $J_0$, A/m$^2$ | $10^9$ | $10^{12}$ | $10^{15}$ |
| Metal islands | tungsten | tungsten | tungsten |
| $E_0$, V/nm | 4.57 | 8.19 | 41.7 |
| B | 3.0 | 3.0 | 3.0 |
| S, nm | 530. | 25. | 20. |
| $V_0$ | 655. | 41.0 | 222. |
| Dielectric | hafnium oxide | zirconium-tin-titanate | zirconium oxide |
| $\in_r$ | 30. | 98. | 4.8 |
| EBD, V/nm | 2.4 | 0.70 | 2.0 |
| $E_D$, V/nm | 1.8 | 0.525 | 1.5 |
| $D_1$, $D_2$, nm | 182. | 39. | 74. |
| Y | 0.30 | 0.065 | 0.0029 |
| $f_K$ | 330. MHz | 350. GHz | 2500. THz |
| $J_{RMS}/J_0$ at VM = 1.0 | 0.385 | 0.479 | 0.284 |
| $f_P$ at VM = 1. | 800. MHz | 500. GHz | (405 nm) |
| $J_{RMS}/J_0$ at VM = 1.2 | 0.639 | 0.638 | 0.392 |
| $f_P$ at VM = 1.2 | 400. MHz | 300. GHz | (405 nm) |
| $J_{EFF}$, A/m$^2$ at VM = 1.0 | $1.2 \times 10^8$ | $3.1 \times 10^{10}$ | $8.2 \times 10^{11}$ |
| $J_{EFF}$, A/m$^2$ at VM = 1.2 | $1.9 \times 10^8$ | $4.1 \times 10^{10}$ | $1.1 \times 10^{12}$ |

Suggested Applications for the Three Examples

Devices similar to the three examples could be used to supply electrons with much greater current in many different applications. In some of these the frequency of the source that is required to drive the devices would only be pertinent as a requirement for capacitive ballasting, but there are others in which the requirement for high frequencies is synergistic with the application. One of these will now be considered—new nonlinear devices to generate harmonics and mixer signals, particularly at terahertz frequencies.

Microwave and terahertz radiation can be generated by photomixing (optical heterodyning) in laser-assisted field emission [8]. In effect, an ultrafast non-linear optical medium is created in laser-assisted field emission because;

(1) The emitter is much smaller than the wavelength of the incident radiation so the potential of the emitter rises and falls to follow each cycle of this radiation;

(2) Tunneling of electrons from the emitter responds to changes in the potential with a delay $\tau$ of less than 2 fs [30]; and (3) The response of the tunneling current to the electric field is highly nonlinear [3]. The nonlinearity in field emission may be used for optical rectification and generating harmonics, as well as mixer signals, with output frequencies from dc to over 500 THz ($1/\tau$) [31].

A stand-alone non-linear device could be made by using antennas to couple radiation to and from the field emitter as is shown in FIG. 3. Thus, incident radiation at a single frequency would act as the source to cause output radiation at harmonics, or incident radiation at two or more frequencies would cause output radiation at mixer frequencies as well as harmonics. Parametric amplifiers or modulators could also be made in which one source may have a lower power and/or lower frequency than the source that drives the device. This could be done using the parameters from any of the three examples. The Manley-Rowe relations, which place a fundamental limit on the conversion efficiency in nonlinear optics materials [32], do not limit the output power with our new technology for generating mixer terms and harmonics at THz frequencies [8] because of the cascaded processes in which the incident radiation releases stored electrical energy in the form of THz radiation [31]. Another advantage of this new technology is that it is not necessary to use phase matching because the non-linear processes occur in a size that is less than the source wavelength, which simplifies the design and construction and also increases the usable bandwidth.

Most of the present sources of terahertz radiation have an output power that is much less than 1 W, but a total output of 100 W is readily produced in a band from 0.1 to 3 THz by the synchrotron radiation from highly relativistic electrons [33]. However, the amplitude of the radiation falls off rapidly with increasing frequency, having a value at 3 THz that is only $10^{-8}$ of the maximum which occurs near 1 THz. A stand-alone nonlinear device similar to that in Example 2 could be used to generate signals at harmonics and mixer frequencies of the terahertz radiation which is generated by synchrotron radiation in order to obtain a much greater usable bandwidth. In this case the thickness of the interface layers may be chosen so that the capacitive reactance passes more current to the antenna at the output frequencies but still provides capacitive ballasting at the lower input frequency. The shunting capacitance between the two electrodes of the field emission diode should always be less than that of the two series capacitors so that capacitive ballasting will function properly.

Delimitations for the Three Examples

At present there is some controversy regarding the significance of space charge on field emission at high current densities. The data from field emission measurements with a single tungsten nanotip having an emitting area corresponding to R≈2 nm are linear in a Fowler-Nordheim plot at current densities as high as $3.5\times10^{14}$ A/m$^2$, and only deviate from linearity at higher current densities which is attributed to the effects of space charge. Significant space charge effects occur at a lower current density of $2.0\times10^{13}$ A/m$^2$ with zirconium oxide spots and this difference was attributed to the work function being much lower than that of tungsten [2]. To summarize these experimental results suggest that the Fowler-Nordheim equation would be appropriate for analysis in the three examples, which used tungsten islands. However, others have reported that the effects of space charge must be included in determining the electric field at the cathode, instead of only using the values of $V_0$, $\beta$, and S, to obtain valid results with the Fowler-Nordheim equation at current densities greater than $5\times10^{10}$ A/m$^2$. Thus space charge effects require that higher applied voltages must be used to obtain the greater currents [34].

In step 2 of the 10 steps that were used to design the 3 examples it was mentioned that the numerical modeling, which is also required in steps 8 and 9, may be done using the Fowler-Nordheim equation or other means as may be appropriate for simulating field emission. In fact, a rigorous solution of the time-dependent Schrödinger Equation was used to determine $E_0$ in step 2 and the current density in steps 8 and 9 to prepare the three examples, but this procedure does not allow for the effects of space charge. Now, in order to determine if space charge would cause a significant effect in the performance of devices based on the three examples, we have calculated the values for the transit time $\tau_T$, and the mean time between the emission of electrons from each island $\tau_E$, with other parameters that are presented in the following table:

TABLE 7

Additional performance parameters for the three examples.

| | Example 1 | Example 2 | Example 3 |
|---|---|---|---|
| $T_T$ | 32.7 fs | 4.56 fs | 2.09 fs |
| $J_{RMS}$, A/m$^2$ at VM = 1.0 | $3.85\times10^{8}$ | $4.79\times10^{11}$ | $2.84\times10^{14}$ |
| $T_E$ | 13.2 fs | 1.06 fs | 0.0112 fs |
| $f_P$ at VM = 1.0 | 800. MHz | 500. GHz | (405 nm) |
| $T_P$ | 1.25 ns | 2.00 ps | 1.35 fs |
| $T_T/T_E$ | 2.47 | 4.29 | 186 |
| $T_T/T_P$ | $2.62\times10^{-5}$ | $2.28\times10^{-3}$ | 1.55 |

The results for Example 1 and Example 2 that are shown in Table 7 show consistency with the assumption that the effects of space charge were neglected in the simulations. However, for Example 3 the transit time is much greater than the mean time between the emission of electrons from each island and the transit time is also greater than the period, which shows that electrons would accumulate to form a space charge. This suggests that the solution for Example 3 is not valid.

The principles that were applied to generate all three examples are valid, but Example 3 has an unusually large value of $E_0$ which must be further increased to allow for the effects of space charge. Lasers could satisfy the requirement for a stronger electric field, but materials with a greater dielectric constant and EBD than those in Table 5 would be required to cause the transit time to be less the period of the applied field so that the device would function properly. Thus, it is possible synthetic dielectrics, photonic lattices, or other advanced materials could be used to fabricate devices that would correspond to Case 3.

Possibility of Further Increasing the Current by the Triple-Point Effect

The interface layer must be a dielectric for capacitive ballasting, so triple-point enhancement of the electric field will occur at the edge of each island to increase the field emission current from said edge by a factor that is approximately equal to the dielectric constant [35], which adds to the current that is emitted from the exposed surface of the island. Thus, the density of the total current flowing through the base of each island may be further increased. A "triple point" is a two-dimensional junction that is formed where wedges of three media meet; an electrical conductor, a first dielectric, and a second dielectric, each occupying a specific dihedral angle.

The electric field is intensified near this common junction, especially for specific values of the dihedral angles, and this effect has been used to construct cold cathodes [35-37].

Requirement for Excellent Current Spreading and Heat Transfer

When others have obtained current densities approaching the theoretical limit of $10^{16}$ A/m$^2$ for field emission by applying the electric field in nanosecond pulses with low duty cycle, or $10^{15}$ A/m$^2$ with extremely small emitters to limit electron-phonon scattering, they have used single emitters grown as asperities on the surface of a tungsten tip [2]. Thus, the heating from ohmic loss at these high current densities is rapidly transferred to the body of the tip, but prior art has not described a means to extend such high current densities over much larger areas.

In the present invention capacitive ballasting with thin films of low-loss dielectrics is used to divide the current evenly between the conductive islands; and this capacitance causes an immediate spread in the current density to a much greater area as it enters each metal electrode. Thus, the current density is reduced by a factor of $\gamma$, which reduces the heating at the spots where the current enters each metal electrode by a factor of $\gamma^2$, which is equal to 0.090, 0.0042, and $8.4\times10^{-6}$, for examples 1, 2, and 3, respectively. The thermal boundary resistance (Kapitza resistance) at the island/dielectric and dielectric/electrode boundaries [38] is reduced by choosing a hard dielectric and using interface mixing [39]. Each metal electrode is immediately flared outward for a transition to the leads or antennas so the electrical and thermal resistances are primarily from spreading resistance in the electrodes [40]. A full simulation of the heat transfer in a device would be complicated by phenomena that occur at the nanometer scale, which generally increase the thermal conductance [41,42], but it is clear that the energy dissipation and thermal resistance can be mitigated by adjusting $\gamma$ and the other design parameters.

Although the present invention has been described with reference to preferred embodiments, numerous modifications and variations can be made and still the result will come within the scope of the invention. No limitation with respect to the specific embodiments disclosed herein is intended or should be inferred.

REFERENCES CITED

The following references are herein incorporated by reference in their entirety as they provide helpful supporting information for the disclosure above. Endnotes in the specification above refer to the number denoting each reference that follows.

1. G. N. Fursey, Field Emission in Vacuum Microelectronics, Kluwer, N.Y., 2005.
2. G. N. Fursey, L. M. Baskin, D. V. Glazanov, A. O. Yevgen'ev, A. V. Kotcheryzhenkov and S. A. Polezhaev, "Specific features of field emission from submicron cathode surface areas at high current densities," J. Vac. Sci. Technol. B 16 (1998) 232-237.
3. R. Gomer, Field Emission and Field Ionization, American Institute of Physics, New York, 1993.
4. T. Fujieda, K. Hidaka, M. Hayashibara, T. Kamino, Y. Ose, H. Abe, T. Shimizu and H. Tokumoto, "Direct observation of field emission sites in a single multiwalled carbon nanotube by Lorentz Microscopy," Jpn. J. Appl. Phys. 44 (2005) 1661-1664.
5. E. Takahashi and M. Sone, "Observation of field emission sites and study of heat treatment effects," IEEE Trans. Dielect. Electr. Insul. 5 (1998) 929-934.
6. M. Okawa, T. Shiori, H. Okubo and S. Yanabu, "Area effect on electric breakdown of copper and stainless steel electrodes in vacuum," IEEE Trans. Electr. Insul. 23 (1988) 77-81.
7. B. M. Cox, "The nature of field emission sites," J. Phys. D, 8 (1975) 2065-2073.
8. M. J. Hagmann, "Photomixing in resonant laser-assisted field emission—A new technique for wideband-tunable Terahertz sources," IEEE Trans. Microwave Theory Tech. 52 (2004) 2361-2365.
9. G. Moddell and B. J. Eliasson, "High Speed Electron Tunneling Devices," U.S. Pat. No. 7,105,852, issued Sep. 12, 2006.
10. C. A. Spindt, C. E. Holland, P. R. Schwoebel and I. Brodie, "Field-emitter-array development for microwave applications," J. Vac. Sci. Technol. B 14 (1996) 1986-1989.
11. R. H. Taylor and J. D. Levine, "Cluster Arrangement of Field Emission Microtips on Ballast Layer," U.S. Pat. No. 5,541,466, issued Jul. 30, 1996.
12. S. V. Johnson, B. F. Coll and K. O'Connor, "Charge Ballast Electronic Circuit for Charge Emission Device Operation," U.S. Pat. No. 6,819,054, issued Apr. 29, 2004.
13. A. I. Akinwande and L. F. Velasquez-Garcia, "Dense Array of Field Emitters Using Vertical Ballasting Structures," Published patent application 2009/0072750, filed Sep. 19, 2008.
14. T. Utsumi, "Historical Overview," in W. Zhu ed., Vacuum Microelectronics, Wiley, N.Y., 2001.
15. C. O. Bozler, C. T. Harris, S. Rabe, D. D. Rathman, M. A. Hollis, and H. I. Smith, "Arrays of gated field-emitter cones having 0.32 μm tip-to-tip spacing," J. Vac. Sci. Technol. B 12 (1994) 629-632.
16. G. L. Bilbro, Theory of nanotip formation," J. Vac. Sci. Technol. B 20 (2002) 757-761.
17. E. G. Pogorelov, A. I. Zhbanov and Y.-C. Chang, "Field enhancement factor and field emission from a hemi-ellipsoidal metallic needle," Ultramicroscopy, 109 (2009) 373-378.
18. S. Chattopadhyay, L.-C. Chen and K.-H Chen, "Nanotips: Growth, model, and applications," Crit. Rev. Solid State 31 (2006) 15-53.
19. M. Wang, Z. H. Li, X. F. Shang, X. Q. Wang and Y. B. Xu, "Field-enhancement factor for carbon nanotube array," J. Appl. Phys. 98 (2005) 014315.
20. K. M. Choi, S. Jin, G. P. Kochanski and W. Zhu, "Field Emitting Device Comprising Field-Concentrating Nanoconductor Assembly and Method for Making the Same," U.S. Pat. No. 6,538,367, issued Mar. 25, 2003.
21. S. R. P. Silva, G. A. J. Amaratunga and J. R. Barnes, "Self-texturing of nitrogenated amorphous carbon thin films for electron field emission," Appl. Phys. Lett. 71 (1997) 1477-1479.
22. F. Song, F. Zhou, H. Bu, X. Wang, L. He, M. Han, J. Wan, J. Zhou and G. Wang, "Films with discrete nano-DLC-particles as the field emission cascade," J. Phys. D: Appl. Phys. 41 (2008) 042001
23. N. Mansour, M. J. Soileau and E. W. Van Stryland, "Picosecond damage in $Y_2O_3$ stabilized cubic zirconia," in Laser Induced Damage in Optical Materials: 1984, H. E. Bennett, A. H. Guenther, D. Milam, and B. E. Newnam, eds., National Bureau of Standards Special Publication 727, 1986, pp. 31-38.
24. J. Han, C. Li, M. Zhang, H. Zuo and S. Meng, "An investigation of Jong pulsed laser induced damage in sapphire," Op. Laser Technol. 41 (2009) 339-344.

25. R. S. Sussmann, G. A. Scarsbrook, C. J. H. Wort and R. M. Wood, "Laser damage testing of CVD-grown diamond windows," Diam. Relat. Mater. 3 (1994) 1173-1177.
26. J. B. Oliver, S. Papernov, A. W. Schmid and J. C. Lambropoulos, "Optimization of laser-damage resistance of evaporated hafnia films at 351 nm," Proc. SPIE Vol. 7132 (2008) 71320J.
27. Y. Yasojima, Y. Ohmori, N. Okumura and Y. Inuishi, "Optical dielectric breakdown of alkali-halide crystals by Q-switched lasers," Jpn. J. Appl. Phys. 14 (1975) 815-824.
28. M. A. Angadi, T. Watanabe, A. Bodapati, X. Xiao, O. Auciello, J. A. Carlisle, J. A. Eastman, P. Keblinski, P. K. Schelling and S. R. Phillpot, "Thermal transport and grain boundary conductance in ultrananocrystalline diamond thin films," J. Appl. Phys. 99 (2006) 114301.
29. A. Goel, C. Venkatraman, B. F. Dorfman, M. Abraizov, T. G. Engel and N. G. Lotere, "Diamond-like nanocomposites coatings possessing high dielectric strength," Proceedings of the IEEE International Conference on Conduction and Breakdown in Solid Dielectrics, 1995, pp. 690-695.
30. M. J. Hagmann, "Stable and efficient numerical methods for solving the Schrödinger Equation to determine the response of tunneling electrons to a laser pulse," Int. J. Quant. Chem. 70 (1998) 703-710.
31. M. J. Hagmann, "Single-photon and multiphoton processes causing resonance in the transmission of electrons by a single potential barrier in a radiation field," Int. J. Quant. Chem. 75 (1999) 417-427.
32. A. V. Petukhov, V. L. Brundy, W. L. Mochan, J. Maytorena, B. Mendoza and T. Rasing, "Energy conservation and the Manley-Rowe Relations in surface and non-linear optical spectroscopy," Phys. Rev. Lett. 81 (1998) 566-569.
33. G. P. Williams, "High-power terahertz synchrotron sources," Phil. Trans. R. Soc. Lond. A362 (2004) 403-414.
34. A. V. Batrakov, I. V. Pegel and D. I. Proskurovskii, "Limitation of the field emission current density by the space charge of the emitted electrons," Technical Physics Letters 25 (1999) 454-455.
35. L. Schacter, "Analytic expression for triple-point electron emission from an ideal edge," Appl. Phys. Lett. 72 (1998) 421-423.
36. N. M. Jordan, Y. Y. Lau, D. M. French, R. M. Gilgenbach and P. Pengavanich, "Electric field and electron orbits near a triple point," J. Appl. Phys. 102 (2007) 033301.
37. M. S. Chung, S. C. Hong, P. H. Cutler, N. M. Miskovsky, B. L. Weiss and A. Mayer, "Theoretical analysis of triple junction field emission for a type of cold cathode," J. Vac. Sci. Technol. B 24 (2006) 909-912.
38. C. D. Marshall, A. Tokmakoff, I. M. Fishman, C. B. Eom, J. M. Phillips and M. D. Fayer, "Thermal boundary resistance and diffusivity measurements on thin $YBa_2Cu_3O_{7-x}$ films with MgO and $SrTiO_3$ substrates using the transient grating method," J. Appl. Phys. 73 (1993) 850-857.
39. R. J. Stevens, L. V. Zhigilei and P. M. Norris, "Effects of temperature and disorder on thermal boundary conductance at solid-solid interfaces: Nonequilibrium molecular dynamics simulations," Int. J. Heat Mass Tran. 50 (2007) 3977-3989.
40. M. W. Denhoff, "An accurate calculation of spreading resistance," J. Phys. D: Appl. Phys. 39 (2006) 1761-1765.
41. P.-O. Chapuis, J.-J. Greffet, K. Joulain and S. Volz, "Heat transfer between a nano-tip and a surface," Nanotechnology 17 (2006) 2978-2981.
42. P.-O. Chapuis, S. Volz, C. Henkel, K. Joulain and J.-J. Greffet, "Effects of spatial dispersion in near-field radiative heat transfer between two parallel metallic surfaces," Phys. Rev. B 77 (2008) 035431.

I claim:

1. A field emission device comprising two electrodes, each electrode symmetrically opposed to each other and further comprising:

a. an electrically conductive layer;

b. a dielectric interface layer positioned directly over the electrically conductive layer; and c. a plurality of electrically conductive islands attached on one exposed surface of the dielectric interface layer opposite the electrically conductive layer;

wherein said electrically conductive islands of each electrode alternatively emit electrons and collect electrons as a voltage between said electrically conductive layers changes as a function of time; said dielectric interfaces causing capacitance which divides current caused by said electrons to be evenly between said islands, spreading the current from said islands to a larger area of said electrically conductive layers, thereby reducing heating in said device, and regulating the current from said islands by their capacitive reactance.

2. The field emission device of claim 1, the islands having a dome-like shape, with a radius (R) and a height (h) such that h is between 0.2 and 2 times R, inclusively.

3. The field emission device of claim 2, the dielectric interface layer having a thickness less than $$\frac{R}{\sqrt{\gamma}}$$

inclusively, where γ is a fraction of the surface of each interface layer that is covered by the islands.

4. The field emission device of claim 3, γ being between 1 and 30%, inclusively.

5. The field emission device of claim 2, the islands being made of a refractory metal.

6. The field emission device of claim 5, the refractory metal being selected from the group of refractory metals consisting of: tungsten and molybdenum.

7. The field emission device as described in claim 6, wherein R is less than the mean free path for electron-phonon scattering.

8. A field emission device as described in claim 7, wherein a total capacitive reactance of the interface layers has from 40 to 90% of a total voltage that is applied between the electrically conductive layers, so that the remaining 60 to 10% is between the conductive islands of the two electrodes to cause field emission.

9. The field emission device as described in claim 6, wherein each electrically conductive island is approximately the same size so the islands may have similar values of current.

10. The field emission device as described in claim 9, wherein a total capacitive reactance of the interface layers has from 40 to 90% of a total voltage that is applied between the electrically conductive layers, so that the remaining 60 to 10% is between the conductive islands of the two electrodes to cause field emission.

11. A field emission device as described in claim 10, the dielectric of said interface layer being selected from the group of dielectric compounds consisting of: aluminum nitride, aluminum oxide, bismuth zinc niobate, diamond (UNCD), diamond-like nanocomposites (DLN), hafnium oxide, zirconium oxide, and zirconium-tin-titanate.

12. The field emission device as described in claim 11 where the islands are tungsten hemispheres with R=100 nm, the dielectric interface layers are of hafnium oxide with a thickness of 182 nm and are separated by 530 nm, $\gamma$=30%, and a peak input of 655 Volts at 800 MHz is applied between said electrically conductive layers to obtain a RMS current density of $1.2\times10^{8}$ Amperes per square meter (total current divided by surface of each dielectric interface).

13. A field emission device as described in claim 11 where the islands are tungsten hemispheres with R=10 nm, the dielectric interface layers are of zirconium-tin-titanate with a thickness of 39 nm and are separated by 25 nm, $\gamma$=6.5%, and a peak input of 41 Volts at 500 GHz is applied between said electrically conductive layers to obtain a RMS current density of $3.1\times10^{10}$ Amperes per square meter (total current divided by surface of each dielectric interface).

* * * * *